US005769130A

United States Patent [19]

Brielmann

[11] Patent Number: 5,769,130

[45] Date of Patent: Jun. 23, 1998

[54] SEAT BELT WEAVING PROCESS

[75] Inventor: Roland Brielmann, Herbrechtingen, Germany

[73] Assignee: Carl Stahl GmbH & Co, KG, Herbrechtingen, Germany

[21] Appl. No.: 703,728

[22] PCT Filed: Mar. 7, 1995

[86] PCT No.: PCT/EP95/00829

§ 371 Date: Aug. 27, 1996

§ 102(e) Date: Aug. 27, 1996

[87] PCT Pub. No.: WO95/25836

PCT Pub. Date: Sep. 28, 1995

[30] Foreign Application Priority Data

Mar. 23, 1994 [DE] Germany ..... 44 09 980.0

[51] Int. Cl.[6] ..... D03D 1/00; D03D 13/00

[52] U.S. Cl. ..... 139/22; 139/383 R; 139/431

[58] Field of Search ..... 139/22, 383 R, 139/432, 430, 431

[56] References Cited

U.S. PATENT DOCUMENTS

| | | | |
|---|---|---|---|
| 4,027,703 | 6/1977 | Diesner | 139/22 |
| 4,202,381 | 5/1980 | Bucher | 139/383 R |
| 5,167,263 | 12/1992 | Kelen et al. | 139/22 |
| 5,188,884 | 2/1993 | Smith | 139/383 AA |
| 5,299,603 | 4/1994 | Reiter | 139/431 |

FOREIGN PATENT DOCUMENTS

| | | | |
|---|---|---|---|
| 0 021 104 | 5/1980 | European Pat. Off. | 139/22 |
| 0 579 938 | 4/1994 | European Pat. Off. | 139/22 |
| 33 45 508 | 6/1985 | Germany | 139/383 R |
| 40 09 455 | 9/1991 | Germany | 139/22 |
| 42 23 953 | 1/1994 | Germany | 139/22 |

*Primary Examiner*—Andy Falik

*Attorney, Agent, or Firm*—Welsh & Katz, Ltd.

[57] ABSTRACT

A process for producing a safety belt for use in a motor vehicle comprises the insertion of two yarns into a least one shed. Two weft yarns are inserted over the entire width of the fabric, with one inserted on one side of the fabric and the other on the other side of the fabric at the same time. In addition, a third weft yarn binds over a part of the fabric with warp yarns.

3 Claims, 4 Drawing Sheets

SEAT BELT WEAVING PROCESS

The invention relates to a process for producing a belt, in particular a seat belt for a motor vehicle, in which two weft threads are inserted into at least one shed.

BACKGROUND OF THE INVENTION

The invention relates in particular to a seat belt for a motor vehicle having special requirements, in particular for the anti-roll bar. In the case of belts of this type it normally involves belts woven in a single ply, which are produced with or also without special selvedges.

DESCRIPTION OF THE PRIOR ART

The achievement of these requirements by a simultaneous insertion of a multifilament and monofilament weft thread is known. In addition it is also known that the insertion of the two different weft yarns may occur by two weft needles Acting in the same direction or by two weft needles acting in opposite directions, e.g. EP 0 021 104 A1,DE 40 09 455 A1, DE 33 45 508 C2, EP 0 579 938 A2.

To reduce or respectively to avoid the known disadvantages of the seat belts, e.g. twisting of the belt in the mounting, film roll effect when winding in the belt roller, winding size, but on the other hand a belt fitting smoothly to the person to be secured is required, a belt having a high transverse rigidity is desired. This is achieved, as is generally known, by the insertion of monofilament weft thread or by the insertion of a monofilament and a multifilament weft thread.

By the insertion of a monofilament or also a multifilament and an additional monofilament weft thread, with the weft reversal at least on the weft insertion side a so-called saw selvedge is produced, which results in unpleasant scratches on the skin, clothes and in belt deflection. Even injuries to the skin are not out of the question. Likewise the deflection mountings can be damaged by the saw selvedge, whereby the belt may in turn become damaged.

Seat belts having woven-on hollow selvedges are now known e.g. from EP 0 021 104 A1. In this case a multifilament and a monofilament weft thread, which run in the same direction or in the opposite direction, are simultaneously inserted into the sheds with its own weft needle in each case. The multifilament weft thread weaves through the main shed and through the selvedge shed, while the monofilament weft thread is only inserted through the main web and consequently is not contained in the selvedge. The wovenon edge parts are closed by tension of the monofilament weft to form hollow selvedges.

However this type of seat belt has considerable disadvantages. These are inter alia: selvedges without full utilization of the tensile strength, considerable cost expenditure, selvedges of unequal thickness, variation in thickness of the selvedge to the center, chafing resistance problems caused thereby.

Seat belts without edge parts are also known (e.g. DE 33 45 508 C2). In this case a multifilament and a monofilament weft thread are also simultaneously inserted, with no separate selvedges being woven on. A central part and an edge part are formed. The multifilament weft thread is inserted through the entire belt width, i.e. central part and edge part, while the monofilament weft thread is only inserted into the central part of the belt. Only for the central part are both weft threads inserted into a common shed.

This type of seat belt also has considerable disadvantages. Thus for example the two fabric selvedges are not uniform, i.e. there are uneven selvedges. The tensile strength may decrease by varying warp take-up (in the central part monofilament and multifilament weft threads, in the edge parts only a multifilament weft thread, which corresponds to a change in the diameter of the weft thickness) between central part and edge part. Moreover a dent bar may under some circumstances be produced between the edge part and central part by the weft reversal, i.e. by the weft loops of the monofilament weft, which as is known are harder and more brittle. There is also the danger that squeeze rollers during the subsequent processing work the weft loops of the monofilament yarn on the multifilament warp and weft threads in such a manner that these may be damaged. The density of the fabric between central part and the edge parts or the edge part varies, which by necessity results in a uneven fabric density.

Seat belts without edge parts with weft needles operating in opposite directions are also known (e.g. DE 40 09 455 A1). With this process a monofilament weft thread is inserted from the one side and finished off on the other side, while the multifilament weft thread is inserted from the other side and is finished off on the one side. Both weft threads are inserted into a common shed.

With this process and/or with this belt the weft thread loops of the monofilament weft thread are covered from the one side only by the part of a loop. Since however a selected auxiliary thread for producing the loop is generally finer, so as not to obtain any casting-on course, than the inserted weft thread, this coverage of the monofilament weft thread loops is unsatisfactory. Even with the choice of a thicker or additional auxiliary thread or even blocking thread, without casting on no reliable coverage of the monofilament weft loops can be achieved.

This means that the formation of saw selvedges occurs and their avoidance is not achieved as previously was the case.

In other known embodiments the monofilament thread is inserted only in the central part with two weft needles working in opposite directions, whereby the weft needle with the multifilament weft thread forms the central part and the two edge parts and that weft needle with the monofilament weft thread only additionally also forms the central part.

In this embodiment too the disadvantages already mentioned in the previous embodiment and process cannot be avoided.

SUMMARY OF THE INVENTION

The object of the present invention is therefore to create a process for weaving a belt and a belt weaved thereby, in which firstly no saw selvedges occur at the belt selvedges and secondly no losses in tensile strength occur and edges are produced which are similar or of similar appearance or similar design.

Furthermore in the subsequent processing the danger of damage to the thread or woven fabric respectively by squeeze rollers through the inner weft loops should be avoided as far as possible. A universal application for parts of the preceding problems should also be guaranteed, so that fabrics with or without selvedges and/or edge parts can be woven.

This object is achieved in accordance with the invention by the features given in the characterising part of claim 1.

Identical selvedges can be formed on both sides by the weaving process with a total of 3 weft threads in the stated manner. Furthermore the formation of saw selvedges is avoided, as the weft thread responsible for this, namely the monofilament weft thread, can be appropriately covered and in fact independently of whether it is passed right to the respective outer warp thread or not. In this case the two weft needles for the weft threads running in opposite directions are provided for the multifilament yarn and are inserted over the entire fabric width. Even if only one of the three weft threads extends only over a part of the fabric width, a good utilization of the tensile strength is nevertheless achieved.

A further advantage of the process according to the invention lies in that edge parts can be formed in conventional weaving techniques with the two multifilament weft threads running in opposite directions.

The weft needle for the third weft thread, namely the monofilament yarn, can be simultaneously inserted over the entire fabric width or also over a part. Likewise the monofilament yarn can be passed out only on one side, e.g. on the left or one the right, over the outer warp thread.

In an advantageous embodiment of the invention it may be specified that the weft threads passed out over the outer warp thread are bonded, secured or fixed to themselves or each side with at least one auxiliary thread.

In accordance with the invention each of the three weft yarns can be individually bonded with all known weaving systems. Likewise each of the weft yarns can be bonded in a differentiated weaving system.

In an embodiment according to the invention it may be specified that the multifilament and monofilament weft thread is bonded jointly from the one side and the multifilament weft thread separately from the other side.

In the weaving process according to the invention, a single-ply weaving technique may advantageously be used.

Of course all conventional weaving techniques may however be used. This means the triple weft insertion is not dependent on the chosen weaving technique.

In accordance with the invention it may be specified that at least in one shed two-ply (to and fro) weft threads are provided at least three times. In this case two-ply (to and fro) weft threads may also be located in a part of the one shed at least three times.

In an advantageous refinement of the invention it may be specified that the weft loops of the monofilament thread are covered by loops of the auxiliary thread or threads or by the loops of the multifilament thread and by the weft reversal of the synchronous or accompanying multifilament weft thread.

A further solution for avoiding saw selvedges may lie in that the weft reversal of the monofilament thread is drawn into the fabric via its own tension through the loop shank of the auxiliary thread.

BRIEF DESCRIPTION OF THE DRAWINGS

An exemplified embodiment of the invention is represented in principle below by means of the drawings.

DETAILED DESCRIPTION OF THE DRAWINGS

Figure 1:
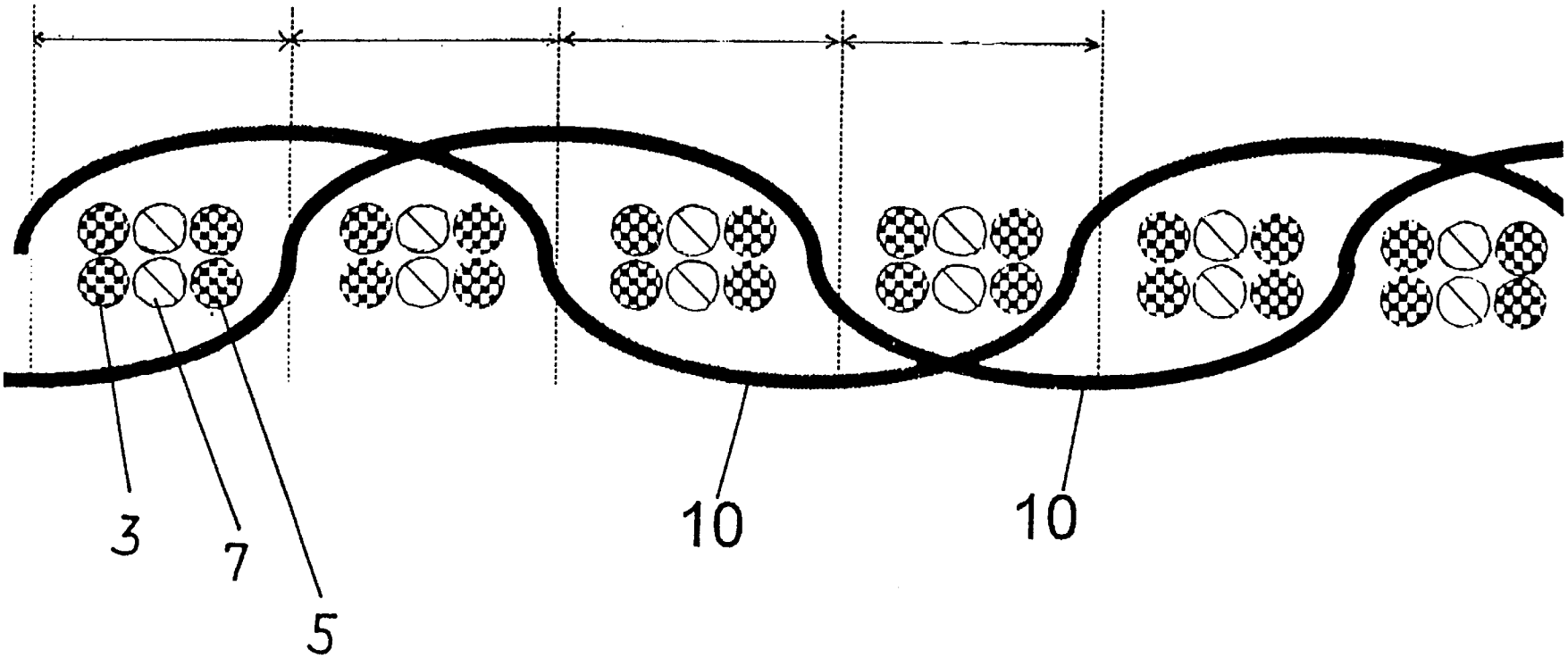
FIG. 1 shows the weave type and the weft insertions with a basic weave K 2/2 with two warp threads, wherein three double wefts are inserted with each change of shed.

1st embodiment without special selvedges:

A general shed is designated by the reference figure "1". A weft needle 2 inserts a multifilament or flexible weft thread 3 from one side through the entire shed 1. A weft needle 4 inserts a further multifilament weft thread 5 coming from the other side through the entire shed.

Figure 2:
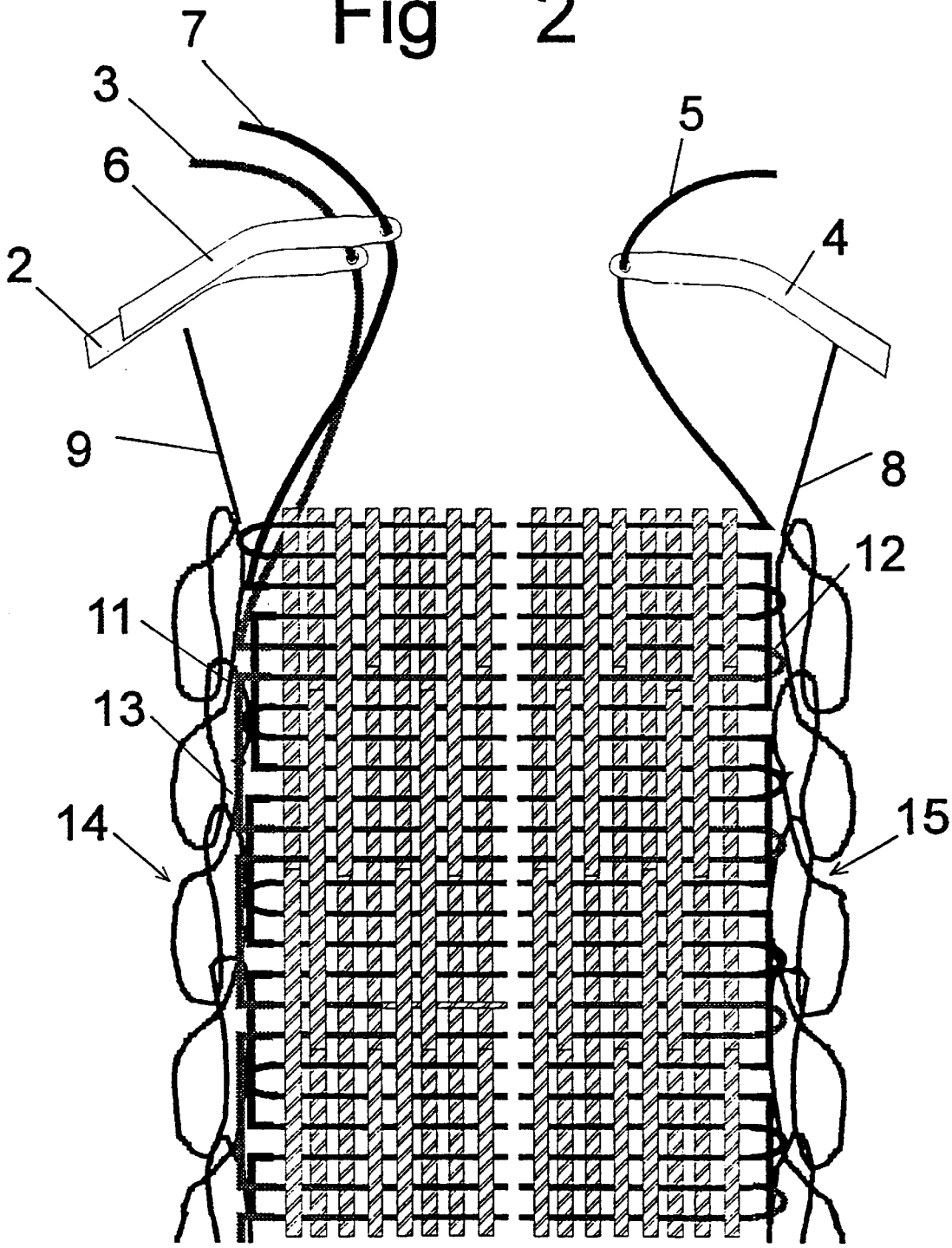
FIG. 2 shows the finishing and the weft loops on both sides of the woven fabric for a complete coverage of the weft loops.
Figure 3:
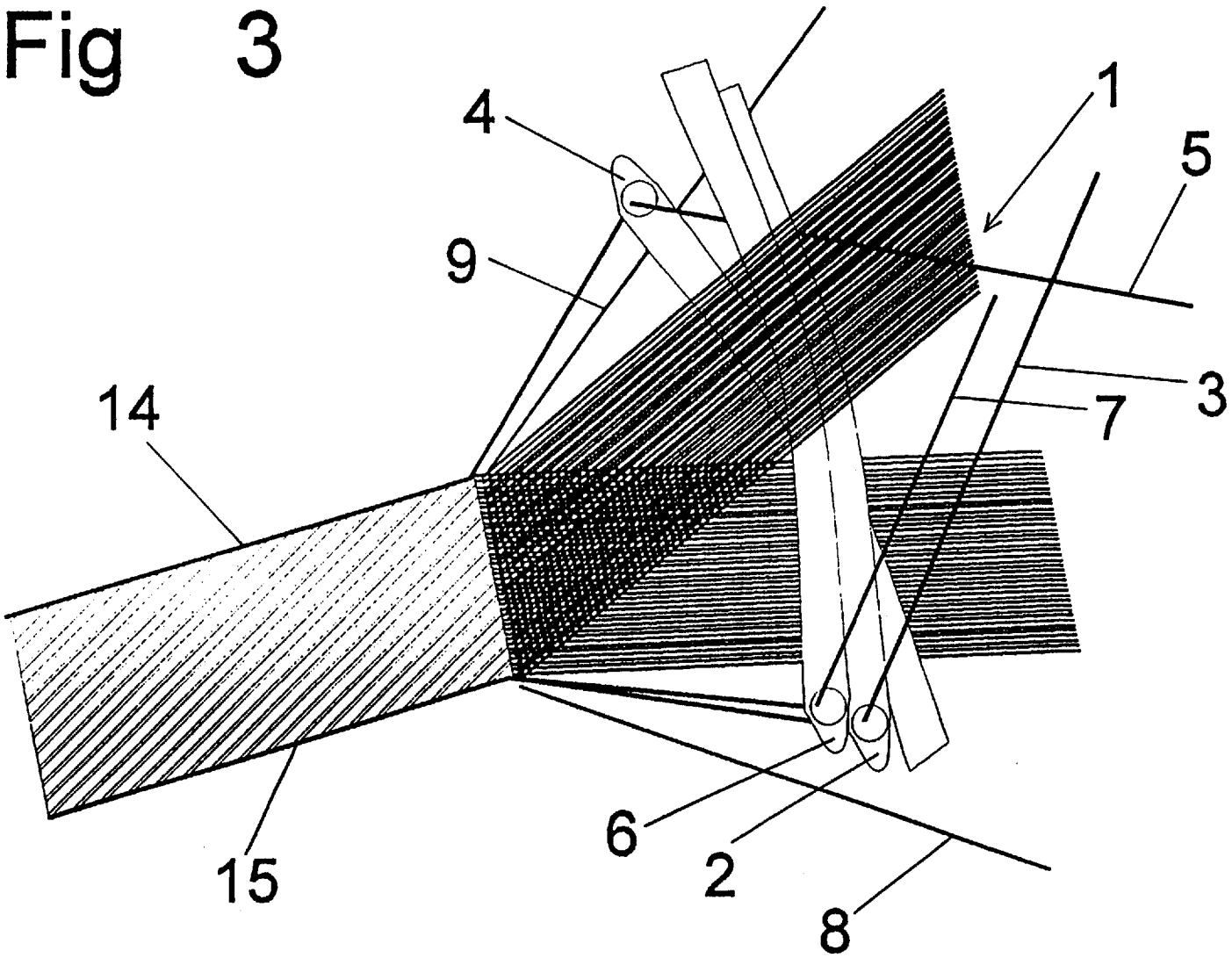
FIG. 3 shows a common shed for weaving without selvedges and without edge parts.

A third weft needle 6, which comes from the same side as the first weft needle 2, inserts a monofilament or stiff weft thread 7, as shown in FIGS. 2 and 3 through the entire shed 1. The multifilament weft thread 3 and the monofilament weft thread 7 are secured by an auxiliary thread 8, i.e. on the side faced away from the insertion side. The multifilament weft thread 5 is secured on the opposite side by an auxiliary thread 9.

Of course the arrangements of the weft needles and also the insertion times are only given as examples. Within the scope of the invention they basically play a subordinate role. Thus it is for example likewise possible to dispose the weft needle 6 with the monofilament weft thread 7 between or beneath the weft needles 2 and 4 with the multifilament weft threads 3 and 5. Likewise it is also possible to insert the weft thread 7 with the monofilament weft into the shed 1 not—as represented—from the left, but from the right.

Within the scope of the invention it is also possible to perform the finishing of the multifilament weft threads 3 and 5 with all customary weaving systems, whereby the finishing of the monofilament weft thread 7 should preferably occur with an auxiliary thread. The finishing of the multifilament weft thread 3 and of the monofilament weft thread 7 occurs in a simple manner jointly with the already mentioned auxiliary thread 8.

The multifilament weft threads 3 and 5 should preferably be half the yarn thickness when compared with a single weft insertion; i.e. if for example a 1100 dtex weft yarn is used with only one weft needle, in the process according to the invention or respectively with the belt produced thereby, the half finenesses, i.e. two weft yarns each with 550 dtex are used. The fineness of the singly inserted monofilament weft thread 7 may remain with the original choice.

On the basis of the common weft insertion, double weft insertion in opposite directions and triple weft insertion, a belt is produced by which the object is achieved with this exemplified embodiment as follows:

The weft threads 3, 5 and 7 are inserted over the entire belt width, i.e. over each warp thread 10, whereby a uniform fabric density with identical weft yarn insertion over the belt width guarantees an identical take-up of the warp threads 10 and consequently an optimal strength utilization is guaranteed.

By virtue of the catching and finishing off of the multifilament weft thread 3 and of the monofilament weft thread 7 on the other side by an auxiliary thread 8, the monofilament weft loops 12 and multifilament weft loops are drawn by their own weft tension into the belt so that none of these weft loops can come out of the fabric edge. This means that the loop 15 formed by the auxiliary thread 8 consequently lies externally at the woven fabric edge. In principle such a finishing operation is however known for all needles of the looms.

However on the one side the weft reversal 11 of the hard and brittle monofilament weft thread 7 would produce saw selvedges. Simultaneously with the weft insertion of the multifilament weft thread 3 and of the monofilament weft thread 7, the multifilament weft thread is now inserted in the opposite direction from the other side and is also at the same time finished off with the other side on the one side by means of an auxiliary thread 9. Since the loop 14 formed by the auxiliary thread 9 however catches and secures only the other multifilament weft thread 5, now on the one side likewise only the loop 14 now lies externally at the fabric edge. The weft loops 11 of the monofilament thread, also called weft heads, are completely and permanently covered by the loop 14 and by the weft reversal of the accompanying and respectively synchronous multifilament weft thread 3, by which saw selvedges are now avoided on both sides.

By choosing the thickness of the two auxiliary threads 8 and 9, and also by choosing the used weaving systems, the final quality of the selvedge can be individually formed.

At the same time an identical selvedge is achieved on both sides by the outer loop 14 on the one side and the outer loop 15 on the other side.

In a further development the weaving system can be selected so that for the selvedges the same weaving systems or however also different weaving systems apply.

Figure 4:
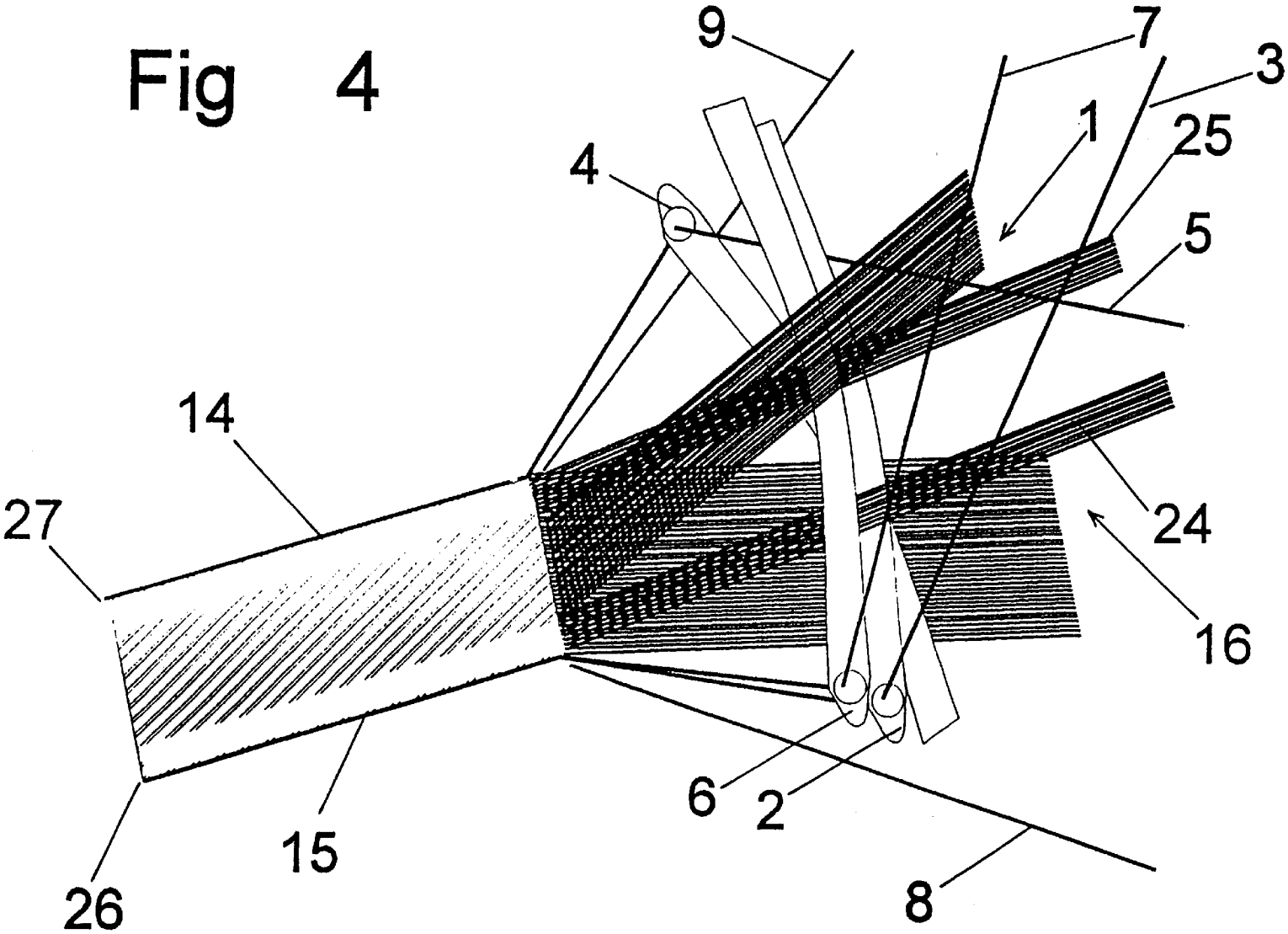
FIG. 4 shows a common shed central part for all three weft needles and a partial traverse shed for edge parts or respectively for a selvedge woven by a special weaving technique for only two of the three weft needles, whereby the partial traverse sheds can be used on both sides or also only on one side.

2nd Exemplified embodiment with two special selvedges or edge parts respectively as shown in FIG. 4:

In this exemplified embodiment the one weft needle 2 carries the multifilament weft thread 3 likewise through the entire shed 1, while at the same time the third weft needle 6 carries the monofilament weft thread 7 only through a predefined region of e.g. a partial traverse shed 16. The simultaneously inserted weft threads 3 and 7 can be jointly and also individually caught and finished on the other side depending on the design. At the same time the other or second weft needle 4 respectively with the multifilament weft thread 5 likewise carries through the entire shed 1 and is secured on the one side by e.g. an auxiliary thread 9. As a result of the partial traverse shed, which limits the insertion of the third weft needle 6 with the monofilament weft thread to a desired width, the monofilament weft threads 7 do not extend to the edge of the woven fabric. In the same way as in the first exemplified embodiment, in this exemplified embodiment too the arrangement of the weft needles is only defined as an example. The same applies for the insertion directions and the finishing operations with or without auxiliary threads.

In this exemplified embodiment the object set is achieved as follows:

The weft threads 3 and 5 are inserted over the entire belt width, i.e. over each warp thread 10, so that a better strength utilization than with separately woven hollow selvedges takes place. The previously defined width for the monofilament weft thread may be laid up to a maximum of one warp thread at the edge of the total width.

The symmetrically constructed selvedges are produced by the weft insertions working in opposite directions of the multifilament weft of the one side 3 and the multifilament weft of the other side 5. The weft loops of the monofilament weft thread 11 lie within the woven fabric according a predefined width of the weft insertion, so that no saw selvedges can be produced, since the monofilament weft 7 does not go to the fabric edge.

The in total 3×2 ply weft threads, (see FIG. 1), lie parallel in the woven fabric, so that the final appearance of the fabric is more even and more uniform than in a woven fabric having 2×2 ply weft threads lying parallel, in which one weft is considerably thicker than the other weft. If for optical reasons or other reasons hollow selvedges or round selvedges come to be used instead of the simple edge parts, the above procedure is followed. In this case the edge parts are chosen in an appropriate weaving technique. All weaving techniques known for this application can be used. The selvedge designs can be individually chosen with respect to material type, material strength and material density.

I claim:

1. A loom process for weaving a fabric of a seat belt for a motor vehicle, the seat belt having a length and width, said process comprising the steps of:

inserting a first flexible weft thread from a first loom side into a weaving shed;

inserting a second flexible weft thread from an opposite side into said shed;

inserting a stiff weft thread from said first side through said shed;

securing said first flexible weft thread and said stiff weft thread with a third thread on said opposite side; and securing said second flexible weft thread on said first side with a fourth thread.

2. The process of claim 1 wherein said stiff weft thread is inserted between said first flexible weft thread and said second flexible weft thread.

3. A loom process for weaving a fabric of a seat belt for a motor vehicle, the seat belt having a length and width, said process comprising the steps of:

inserting a first flexible weft thread from a first loom side into a weaving shed;

inserting a second flexible weft thread from an opposite side into said shed;

inserting a stiff weft thread from said opposite side through said shed;

securing said first flexible weft thread and said stiff weft thread with a third thread on said opposite side; and securing said second flexible weft tread on said first side with a fourth thread.

* * * * *